US010136475B2

(12) United States Patent
Hase et al.

(10) Patent No.: US 10,136,475 B2
(45) Date of Patent: Nov. 20, 2018

(54) CORD-SHAPED HEATER AND SHEET-SHAPED HEATER

(71) Applicant: KURABE INDUSTRIAL CO., LTD., Hamamatsu-shi, Shizuoka-ken (JP)

(72) Inventors: Yasuhiro Hase, Hamamatsu (JP); Motoyuki Oba, Hamamatsu (JP); Tadao Suzuki, Hamamatsu (JP); Tomoya Ota, Hamamatsu (JP)

(73) Assignee: KURABE INDUSTRIAL CO., LTD., Hamamatsu-shi, Shizuoka-ken (JP)

( * ) Notice: Subject to any disclaimer, the term of this patent is extended or adjusted under 35 U.S.C. 154(b) by 0 days.

(21) Appl. No.: 14/719,316

(22) Filed: May 22, 2015

(65) Prior Publication Data

US 2015/0257205 A1 Sep. 10, 2015

Related U.S. Application Data

(63) Continuation of application No. PCT/JP2013/084415, filed on Dec. 24, 2013.

(30) Foreign Application Priority Data

Dec. 25, 2012 (JP) ..... 2012-280548

(51) Int. Cl.
*H05B 3/02* (2006.01)
*H05B 3/56* (2006.01)
(Continued)

(52) U.S. Cl.
CPC ..... *H05B 3/56* (2013.01); *H05B 3/16* (2013.01); *H05B 3/20* (2013.01); *H05B 2203/003* (2013.01); *H05B 2203/029* (2013.01)

(58) Field of Classification Search
CPC ..... H05B 2203/003; H05B 2203/029; H05B 3/16; H05B 3/20; H05B 3/56
(Continued)

(56) References Cited

U.S. PATENT DOCUMENTS 3,099,578 A 7/1963 Hunter
4,496,469 A * 1/1985 Morimoto ..... C04B 26/32 252/62
(Continued)

FOREIGN PATENT DOCUMENTS

JP S61-047087 A 3/1986
JP H07-078519 A 3/1995
(Continued)

OTHER PUBLICATIONS

International Search Report for PCT/JP2013/084415 dated Feb. 25, 2014.
(Continued)

*Primary Examiner* — Dana Ross
*Assistant Examiner* — Joseph Iskra
(74) *Attorney, Agent, or Firm* — Yokoi & Co., U.S.A.; Toshiyuki Yokoi

(57) ABSTRACT

A cord-shaped heater 10 has a plurality of conductive wires 5*a* that are covered with an insulating film 5*b*. The insulating film 5*b* includes a silicone resin. A quantity of the silicone resin included in the insulating film 5*b* is 40 to 80% by a weight ratio. The conductive wires 5*a* are wound around a core material 3 in a state of being paralleled together. An insulation body layer 7 is formed on an outer periphery of the conductive wires. A part or all of the insulation body layer 7 is formed of a heat-fusing material. A sheet-shaped heater 31 is wherein the cord-shaped heater 10 is arranged on a substrate 11.

6 Claims, 10 Drawing Sheets

(51) Int. Cl.
*H05B 3/20* (2006.01)
*H05B 3/16* (2006.01)

(58) Field of Classification Search
USPC ..... 219/200, 520, 521, 538, 539, 546, 548
See application file for complete search history.

(56) References Cited

U.S. PATENT DOCUMENTS

| | | | | | |
|---|---|---|---|---|---|
| 4,983,814 | A * | 1/1991 | Ohgushi | D02G 3/441 | 219/212 |
| 5,112,419 | A * | 5/1992 | Nakagawa | H01B 7/0861 | 156/245 |
| 6,539,171 | B2 * | 3/2003 | VonArx | H05B 3/54 | 219/487 |
| 8,592,725 | B1 * | 11/2013 | Hunger | H05B 3/34 | 219/211 |
| 2002/0009540 | A1 * | 1/2002 | Sasaki | H05B 3/145 | 427/117 |
| 2002/0040898 | A1 * | 4/2002 | Von Arx | A47J 36/2483 | 219/535 |
| 2002/0088931 | A1 * | 7/2002 | Danisch | G01B 11/18 | 250/227.14 |
| 2005/0067038 | A1 * | 3/2005 | Kobayashi | F16L 59/022 | 138/149 |

FOREIGN PATENT DOCUMENTS

| | | | | |
|---|---|---|---|---|
| JP | 2000-234065 | A | | 8/2000 |
| JP | 2000234065 | | * | 8/2000 |
| JP | 2003-174952 | A | | 6/2003 |
| JP | 2008-039384 | A | | 2/2008 |
| JP | 2008-311111 | A | | 12/2008 |
| JP | 2010-015691 | A | | 1/2010 |
| JP | 2011-171254 | A | | 9/2011 |
| JP | 2011-171255 | A | | 9/2011 |
| JP | 2011-181316 | A | | 9/2011 |
| JP | 2011181316 | | * | 9/2011 |
| KR | 2003-0080648 | A | | 10/2003 |
| KR | 10-2005-0102760 | A | | 10/2005 |
| WO | 2011/001953 | A | | 1/2011 |

OTHER PUBLICATIONS

PCT written openion dated Feb. 25, 2014.
Extended European Search Report dated Aug. 12, 2016.
Korean Office Action dated Jun. 29, 2016.
Canadian Office Action dated May 30, 2016.
Chinese Office Action dated May 26, 2016.
Chinese Office Action dated Oct. 26, 2015.
Korean Office Action dated Dec. 26, 2016.
European Office Action dated Jan. 2, 2017.
Canadian Office Action dated Jan. 30, 2017.

* cited by examiner

| unit | M | D | T | Q |
|---|---|---|---|---|
| structure |  |  |  |  |

CORD-SHAPED HEATER AND SHEET-SHAPED HEATER

CROSS-REFERENCES TO RELATED APPLICATIONS

This application claims the benefit of priority and is a Continuation application of the prior International Patent Application No. PCT/JP2013/084415, with an international filing date of Dec. 24, 2013, which designated the United States, and is related to the Japanese Patent Application No. 2012-280548, filed Dec. 25, 2012, the entire disclosures of all applications are expressly incorporated by reference in their entirety herein.

BACKGROUND OF THE INVENTION

1. Field of the Invention

The present invention relates to a cord-shaped heater and a sheet-shaped heater using the cord-shaped heater. The cord-shaped heater and the sheet shaped heater can be suitably used for an electric blanket, an electric carpet, a car seat heater and a steering heater, for example. In particular, the present invention related to the cord-shaped heater and the sheet-shaped heater having high flame retardancy and capable of preventing generation of spark if, by any chance, a disconnection fault occurs.

2. Description of Related Art

In general, a cord-shaped heater used for an electric blanket, an electric carpet, a car seat heater and the like is known to be formed by spirally winding a heating wire around a core wire and coating an outer cover made of an insulation body layer around them. Here, the heating wire is formed by paralleling or twisting a plurality of conductive wires such as copper wires and nickel-chromium alloy wires together. In addition, a heat-fused portion is formed on an outer periphery of the heating wire. The heating wire is adhered to a substrate such as a nonwoven fabric and an aluminum foil by the heat-fused portion (as shown in Patent document 1, for example).

In the conventional cord-shaped heater, the conductive wires are contact with each other. Therefore, when a part of the conductive wires is disconnected by being pulled or bended, the disconnected part is in the same state as when a diameter of the heating wire is reduced. As a result, a current amount per unit sectional area is increased at the disconnected part and overheating may be caused. On the other hand, it is also known that a heating wire formed by individually covering each of the conductive wires by an insulating film so that each of the conductive wires forms a part of a parallel circuit. By using the above configuration, even if a part of the conductive wires is disconnected, this only means that a part of the parallel circuit is disconnected. Thus, overheating can be prevented (as shown in Patent document 2 and Patent document 3, for example).

In addition, the applicant of the present invention filed Patent document 4 and Patent document 5 as a related technology.

[Patent document 1] Japanese Unexamined Patent Application Publication No. 2003-174952: KURABE INDUSTRIAL CO., LTD.

[Patent document 2] Japanese Unexamined Patent Application Publication No. S61-47087: Matsushita Electric Industrial Co., Ltd.

[Patent document 3] Japanese Unexamined Patent Application Publication No. 2008-311111: KURABE INDUSTRIAL CO., LTD.

[Patent document 4] Japanese Unexamined Patent Application Publication No. 2010-15691: KURABE INDUSTRIAL CO., LTD.

[Patent document 5] International Publication No. WO2011/001953: KURABE INDUSTRIAL CO., LTD.

When actually using the cord-shaped heater, various external forces such as tension and bending may be applied to the cord shaped heater. Since the conductive wires used for the cord-shaped heater are generally made of an extremely thin wire, the conductive wires may be disconnected when the external forces are applied. Even when the conductive wires are disconnected, there is no problem if both ends of the disconnected part are completely separated from each other. However, if the both ends are repeatedly contacted and separated with each other, a spark may be generated.

In Patent documents 2 and 3, various materials are described as the insulating film of the conductive wires. However, a so-called enameled wire is mainly used. In the enameled wire, organic materials such as a polyurethane resin and a polyimide resin are used as a material of the insulating film. When the spark is generated, the above described materials are melted or pyrolyzed by the heat and insulating function is lost. As a result, there is a problem that the exposed part of the conductive wires is increased and the spark can be generated more easily.

The present invention aims for solving the above described problem of the conventional technology. The present invention aims for providing a cord-shaped heater and a sheet-shaped heater using the cord-shaped heater having high flame retardancy and capable of preventing generation of spark if, by any chance, a disconnection fault occurs.

BRIEF SUMMARY OF THE INVENTION

The cord-shaped heater of the present invention is a cord-shaped heater having a plurality of conductive wires that are covered with an insulating film, wherein the insulating film includes a resin comprised of one of an alkyd, a polyester, an urethane, an acrylic, an epoxy and a combination thereof in addition to a silicone resin, and a quantity of the silicone resin included in the insulating film is 10 to 90% by a weight ratio.

In addition, the insulating film can include a resin comprised of one of an alkyd, a polyester, an acrylic and a combination thereof in addition to the silicone resin.

In addition, the insulating film can include a resin comprised of one of an alkyd, polyester and a combination thereof in addition to the silicone resin.

In addition, the conductive wires can be wound around a core material in a state of being paralleled together.

In addition, the quantity of the silicone resin included in the insulating film can be 40 to 80% by the weight ratio.

In addition, a film thickness of the insulating film can be within a range of 1 μm to 100 μm.

In addition, an insulation body layer can be formed on an outer periphery of the conductive wires.

In addition, a part or all of the insulation body layer can be formed of a heat-fusing material. The term "heat-fusing" is used as the same meaning as the terms "heat-bonding" and "melt-bonding" in the present invention.

In addition, the cord-shaped heater can be arranged on a substrate.

In the cord-shaped heater of the present invention, the insulating film formed from the silicone resin has excellent heat resistance and incombustibility. Even if the cord-shaped heater is subjected to high heat when the spark is generated, a silicon oxide film is formed and therefore an insulation can be maintained. Furthermore, a siloxane gas is generated by high heat when the spark is generated. Since the silicon oxide film is precipitated from the siloxane gas at an end surface of the conductive wires and the end surface is insulated, the spark can be prevented after that.

DETAILED DESCRIPTION OF THE INVENTION

Figure 1:
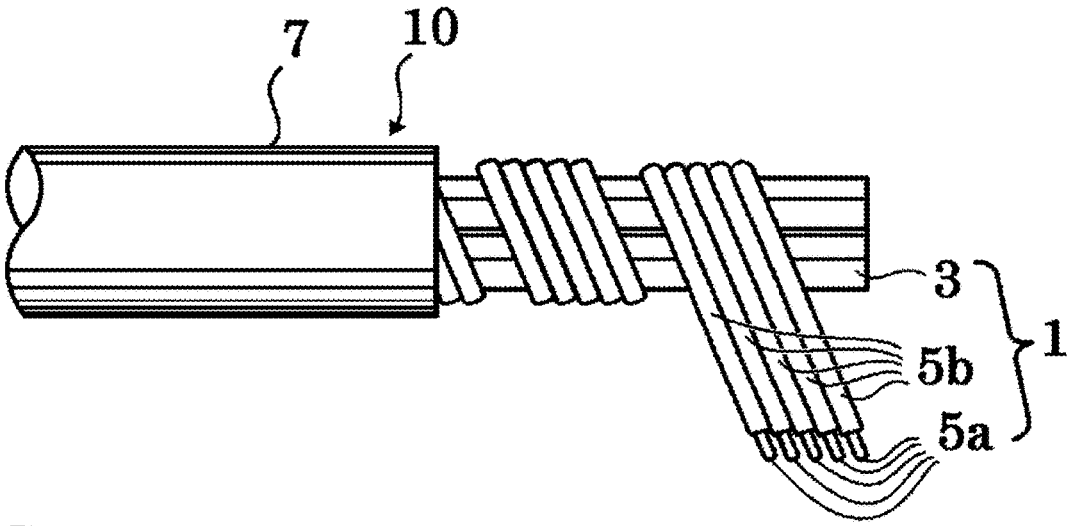
FIG. 1 is a drawing showing an embodiment of the present invention, and is a partially cutaway side view showing a configuration of a cord-shaped heater.

Hereafter, embodiments of the present invention will be explained with reference to FIGS. 1 to 11. In these embodiments, the present invention is used as a sheet-shaped heater and the sheet-shaped heater is assumed to be applied to a vehicle seat heater, as an example.

At first, an embodiment will be explained referring to FIGS. 1 to 5. A configuration of a cord-shaped heater 10 in the embodiment will be explained. The cord-shaped heater 10 in the embodiment has a configuration shown in FIG. 1. A core wire 3 formed of an aromatic polyamide fiber bundle having an external diameter of 0.2 mm is provided. Five conductive wires 5*a*, which are formed of a tin-containing hard copper alloy wire having a strand diameter of 0.08 mm, are spirally wound at a pitch of about 1.0 mm around an outer periphery of the core wire 3 in a state of being paralleled together. On the conductive wires 5*a*, an insulating film 5*b* containing a silicone resin is formed with a thickness of about 5 μm by applying an alkyd silicone varnish (alkyd: silicone resin=50:50) and drying it. A heating wire 1 is formed by winding the conductive wires 5*a* around the core wire 3 and then extrusion-covering a polyethylene resin containing a flame retardant with a thickness of 0.2 mm on an outer periphery of the wound conductive wires 5*a* as an insulation body layer 7. Note that, in the present embodiment, the polyethylene resin used for the insulation body layer 7 functions as a heat-fusing material. The cord-shaped heater 10 has a configuration described above and has a finished outer diameter of 0.8 mm. Although the above described core wire 3 is effective when bendability and tensile strength is considered, a plurality of conductive wires can be used in a state of being paralleled together or twisted together instead of the core wire 3.

Next, a configuration of a substrate 11 to which the above described cord-shaped heater 10 is adhered and fixed will be explained. The substrate 11 of the present embodiment is formed of a nonwoven fabric (areal density: 100 g/m$^2$, thickness: 0.6 mm). The nonwoven fabric is formed by mixing 10% of a heat-fusing fiber having a core-sheath structure and 90% of a flame retardant fiber that is formed of a flame retardant polyester fiber. In the core-sheath structure of the heat-fusing fiber, a low-melting polyester is used as a sheath component. The substrate 11 described above is formed in a desired shape by using conventional methods such as die cutting.

Figure 2:
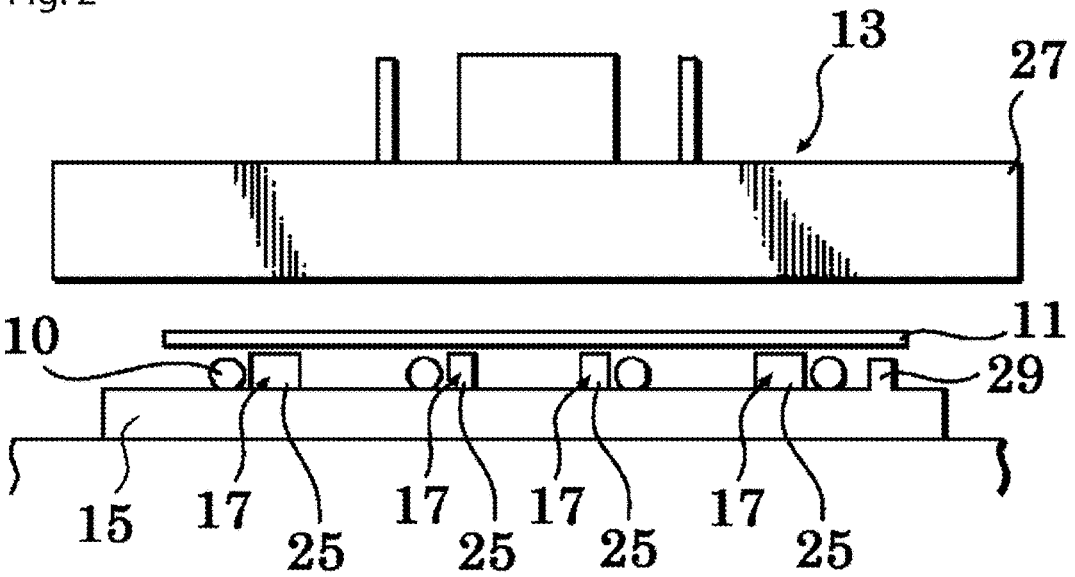
FIG. 2 is a drawing showing an embodiment of the present invention, and is a drawing showing a configuration of a hot press-type heater manufacturing apparatus.
Figure 3:
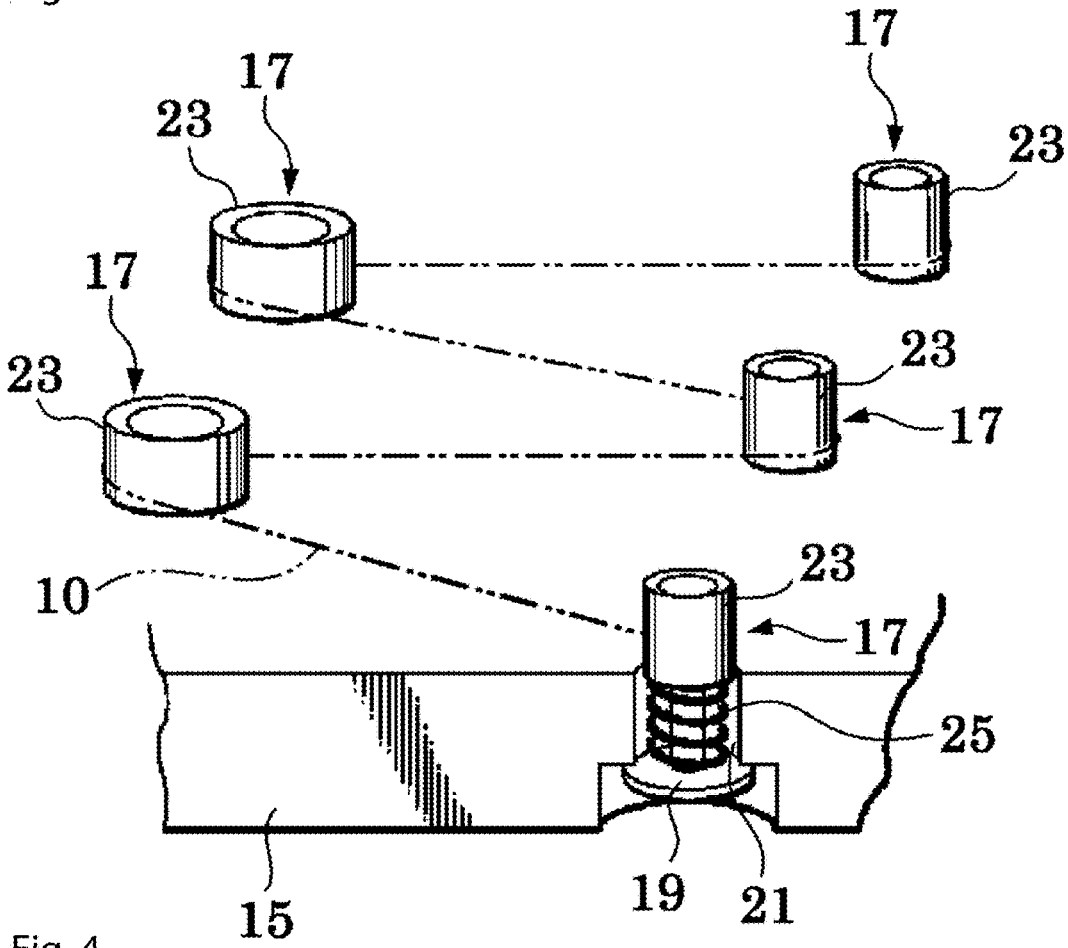
FIG. 3 is a drawing showing an embodiment of the present invention, and is a partial perspective view showing a state that the cord-shaped heater is arranged in a predetermined pattern.

Next, a configuration of arranging the cord-shaped heater 10 on the substrate 11 in a predetermined pattern shape, bonding and fixing them with each other will be explained. FIG. 2 is a drawing showing a configuration of a hot press-type heater manufacturing apparatus 13 that bonds and fixes the cord-shaped heater 10 on the substrate 11. A hot pressing jig 15 is prepared and a plurality of locking mechanisms 17 is provided on the hot pressing jig 15. As shown in FIG. 3, the locking mechanisms 17 have pins 19. The pins 19 are inserted from below into holes 21 bored on the hot pressing jig 15. Locking members 23 are mounted on an upper part of the pins 19 movably in an axial direction. The locking members 23 are always biased upward by coil springs 25. As shown by a virtual line in FIG. 3, the cord-shaped heater 10 is arranged in a predetermined pattern shape by hooking the cord-shaped heater 10 on a plurality of the locking members 23 of the locking mechanisms 17.

As shown in FIG. 2, a press hot plate 27 is arranged above the plurality of the locking mechanisms 17 so as to be raised and lowered. In other words, the cord-shaped heater 10 is arranged in a predetermined pattern shape by hooking the cord-shaped heater 10 on a plurality of the locking members 23 of the locking mechanisms 17, and then the substrate 11 is placed on that. In that state, the press hot plate 27 is lowered so as to heat and press the cord-shaped heater 10 and the substrate 11 at 230° C. for 5 seconds, for example. Thus, the heat-fusing material of the insulation body layer 7, which is a side of the cord-shaped heater 10, is fused to the heat-fusing fiber, which is a side of the substrate 11. As a result, the cord-shaped heater 10 and the substrate 11 are bonded and fixed. A heat-fused structure is formed at a part where the heat-fusing material and the heat-fusing fiber are fused together. Note that, when the press hot plate 27 is lowered for heating and pressing, a plurality of the locking members 23 of the locking mechanisms 17 is moved downward against the biasing force of the coil springs 25.

On the other side surface of the substrate 11, which is a surface on which the cord-shaped heater 10 is not arranged, an adhesive layer can be formed or a double-sided tape can be stuck. These are used for fixing a sheet-shaped heater 31 on a sheet when mounting the sheet-shaped heater 31 on the sheet.

Figure 4:
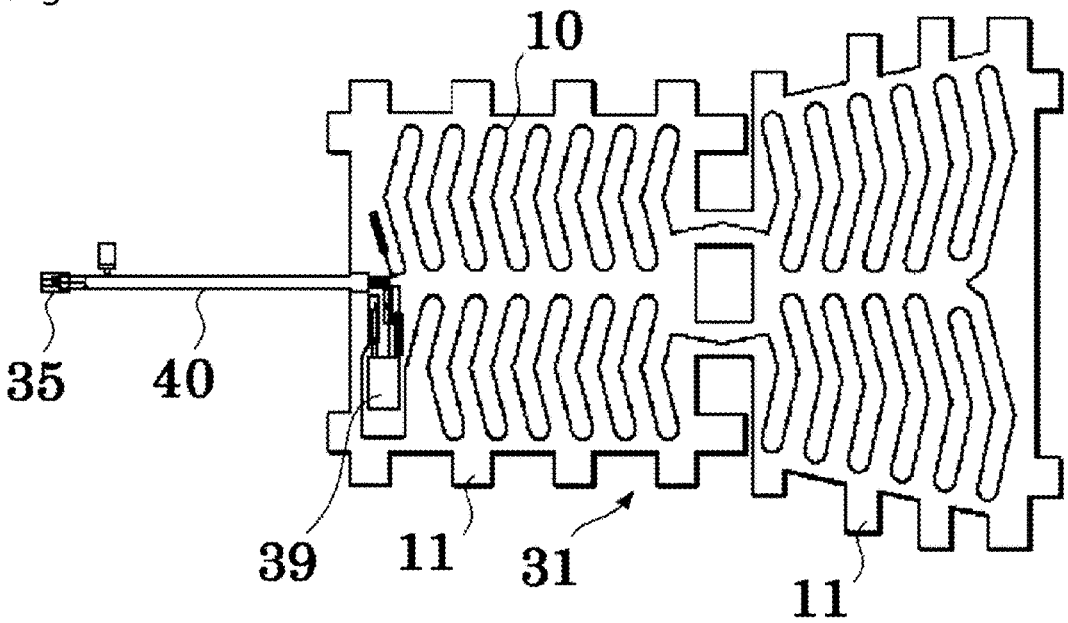
FIG. 4 is a drawing showing an embodiment of the present invention, and is a plan view showing a configuration of a sheet-shaped heater.

By the above described procedures, the sheet-shaped heater 31 for the vehicle seat heater shown in FIG. 4 can be obtained. Note that a lead wire 40 is connected to both ends of the cord-shaped heater 10 of the sheet-shaped heater 31 and connected to a temperature controller 39 by a connection terminal (not illustrated). The cord-shaped heater 10, the temperature controller 39 and a connector 35 are connected with each other by the lead wire 40. The cord-shaped heater 10 is connected to a not illustrated electric system of the vehicle via the connector 35.

Figure 5:
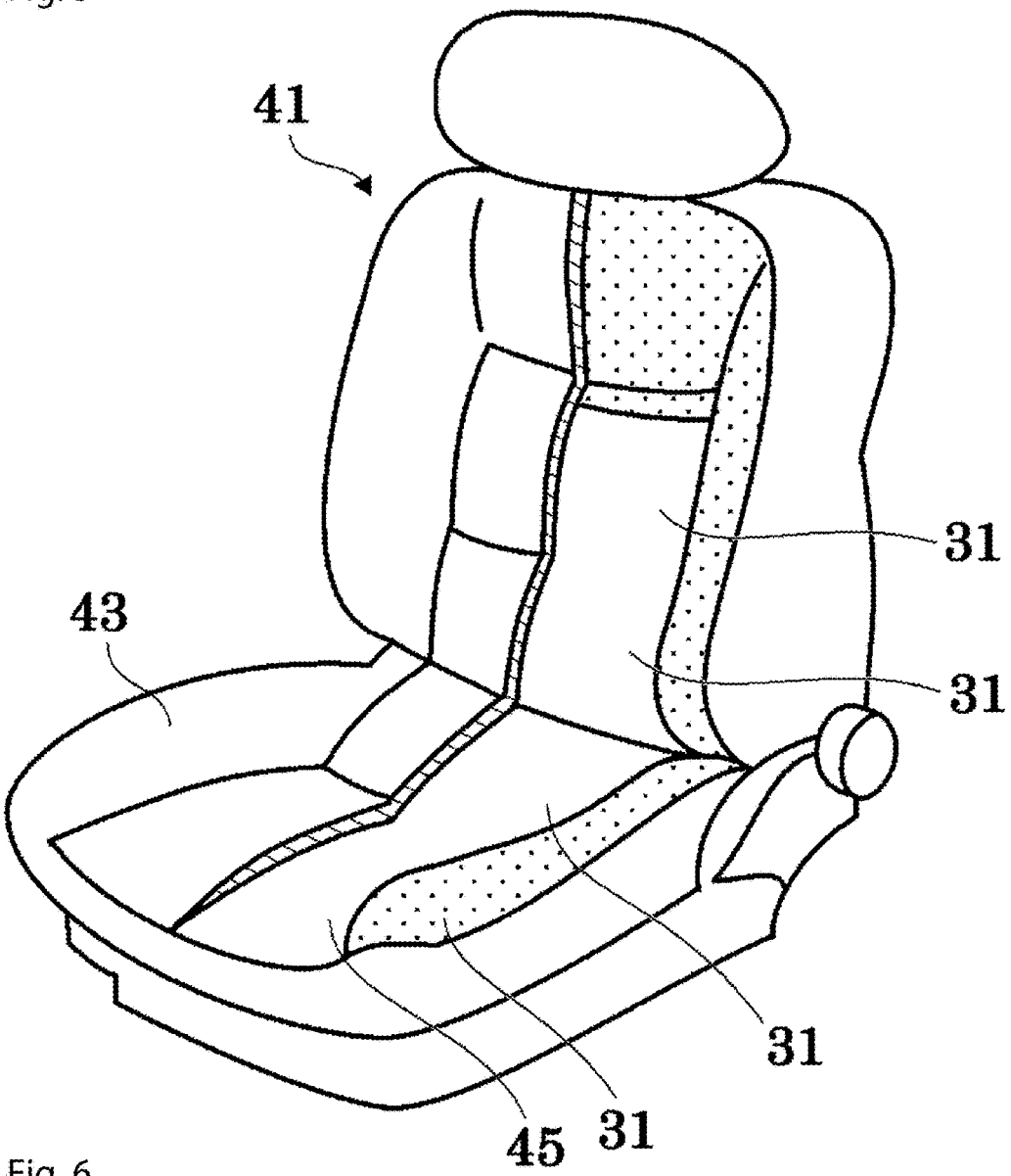
FIG. 5 is a drawing showing an embodiment of the present invention, and is a partially cutaway perspective view partially showing a state that the sheet-shaped heater is embedded in a vehicle seat.
Figure 6:
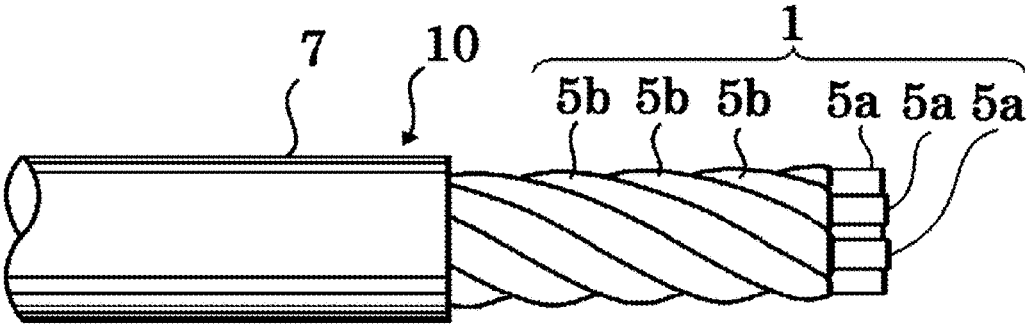
FIG. 6 is a drawing showing another embodiment of the present invention, and is a partially cutaway side view showing a configuration of the cord-shaped heater.
Figure 7:
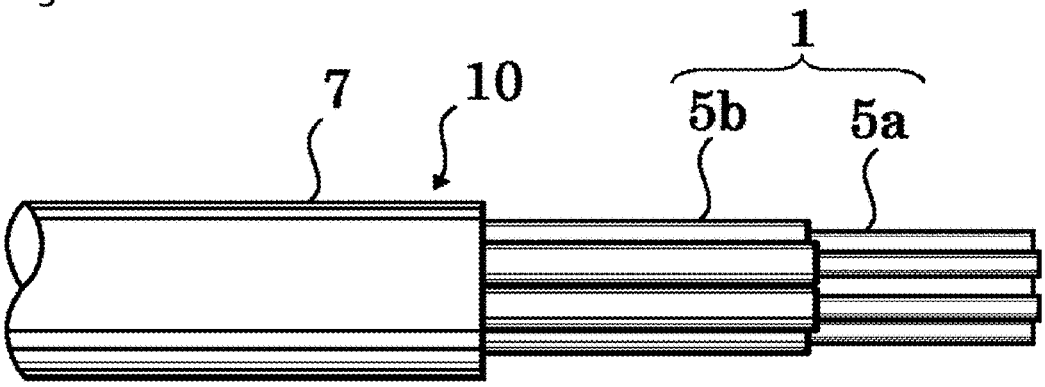
FIG. 7 is a drawing showing another embodiment of the present invention, and is a partially cutaway side view showing a configuration of the cord-shaped heater.

The sheet-shaped heater 31 configured as described above is embedded and arranged in a vehicle seat 41 in a state shown in FIG. 5. In other words, as described above, the sheet-shaped heater 31 is stuck to a skin cover 43 or a seat pad 45 of the vehicle seat 41.

Note that the present invention is not limited to the above described embodiment. First, various conventionally known cord-shaped heaters can be used as the cord-shaped heater 10 as long as the cord-shaped heater has the conductive wires 5*a* covered with the insulating film 5*b* containing the silicone resin.

Regarding the configuration of the heating wire 1, as an example, the heating wire 1 can be formed by twisting or paralleling a plurality of conductive wires 5*a* covered with the insulating film 5*b* together, winding the twisted or paralleled conductive wires 5*a* around the core wire 3, and forming the insulation body layer 7 around an outer periphery of the wound conductive wires 5*a* as described in the above described embodiment (shown in FIG. 1). As another example, the heating wire 1 can be formed by twisting a plurality of conductive wires 5*a* covered with the insulating film 5*b* together (shown in FIG. 6). As another example, the heating wire 1 can be formed by paralleling a plurality of conductive wires 5*a* covered with the insulating film 5*b* together (shown in FIG. 7). Various configurations other than the above described examples are also possible.

Figure 8:
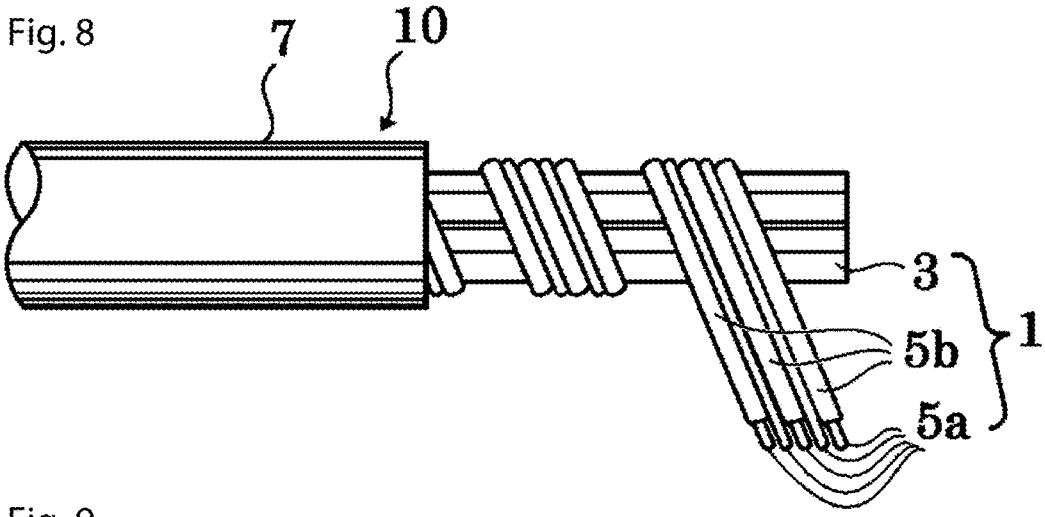
FIG. 8 is a drawing showing another embodiment of the present invention, and is a partially cutaway side view showing a configuration of the cord-shaped heater.
Figure 9:
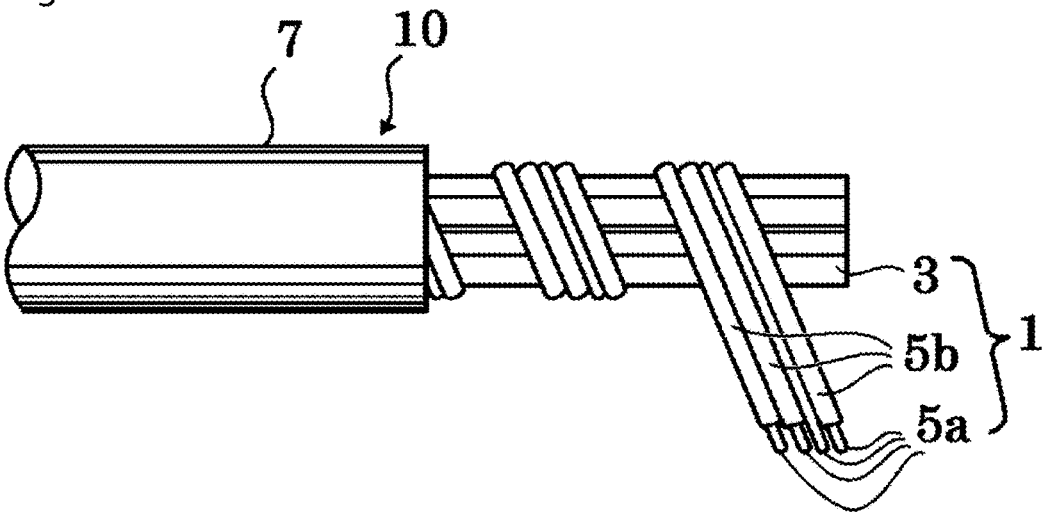
FIG. 9 is a drawing showing another embodiment of the present invention, and is a partially cutaway side view showing a configuration of the cord-shaped heater.

In addition, as another example, the heating wire 1 can be formed by alternatively arranging the conductive wires 5*a* covered with the insulating film 5*b* and the conductive wires 5*a* not covered with the insulating film 5*b* (shown in FIG. 8). Furthermore, the number of the conductive wires 5*a* covered with the insulating film 5*b* can be increased so that the conductive wires 5*a* covered with the insulating film 5*b* are continuously aligned (shown in FIG. 9). Various configurations other than the above described examples are also possible. In addition, the core wire 3 and the conductive wires 5*a* can be twisted together.

As the core wire 3, as an example, a monofilament, a multifilament or a spun of inorganic fibers such as a glass fiber or organic fibers such as a polyester fiber (e.g. polyethylene terephthalate), an aliphatic polyamide fiber, an aromatic polyamide fiber and a wholly aromatic polyester fiber can be used. In addition, a fiber material of the above described fibers can be also used. Furthermore, a fiber formed by covering a thermoplastic polymer material around a core material made of an organic polymer material constituting the above described fiber material can be also used. If the core wire 3 having a heat-shrinkable property and a heat-melting property is used, even when the conductive wires 5*a* is disconnected, the core wire is melted, cut and simultaneously shrunk by the overheat. Since the wound conductive wires 5*a* also follow the function of the core wire 3, both ends of the disconnected conductive wires 5*a* are separated with each other. Therefore, the ends of the disconnected conductive wires are prevented from being repeatedly contacted and separated with each other, and prevented from being contacted by a small contact area such as a point contact. Thus, the overheating can be prevented. If the conductive wires 5*a* are insulated by the insulating film 5*b*, there is no need to carefully select the insulating material of the core wire 3. For example, a stainless steel wire or a titanium alloy wire can be used. However, considering the situation that the conductive wires 5*a* are disconnected, the core wire 3 is preferred to be the insulating material.

Regarding the conductive wires 5*a*, conventionally known materials can be used. For example, a copper wire, a copper alloy wire, a nickel wire, an iron wire, an aluminum wire, a nickel-chromium alloy wire and an iron-chromium alloy wire can be used. As the copper alloy wire, for example, a tin-copper alloy wire, copper-nickel alloy wire, and a silver containing copper alloy wire can be used. In the silver containing copper alloy wire, copper solid solution and silver-copper eutectic alloy are in a fiber shape. From the above listed materials, the copper wire and the copper alloy wire are preferred to be used in the viewpoint of a balance between the cost and characteristics. Regarding the copper wire and the copper alloy wire, although both soft and hard materials exist, the hard material is more preferable than the soft material in the viewpoint of bending resistance. Note that the hard copper wire and the hard copper alloy wire are made by stretching individual metal crystal grains long in a machining direction by cold working such as drawing processing to form a fibrous structure. If the above described hard copper wire and hard copper alloy wire are heated at a temperature higher than a recrystallization temperature, processing strains generated in the metal crystal are removed and crystal nuclei begin to appear to serve as a base of new metal crystal. The crystal nuclei are developed, then recrystallization, which is a process of replacing old crystal grains with new metal crystal grains, occurs sequentially, and then the crystal grains are developed. The soft copper wire and the soft copper alloy wire are materials containing such crystal grains in a developed state. The soft copper wire and the soft copper alloy wire have higher stretchability and higher electric resistance but have lower tensile strength compared to the hard copper wire and the hard copper alloy wire. Therefore, the bending resistance of the soft copper wire and the soft copper alloy wire are lower than that of the hard copper wire and the hard copper alloy wire. As explained above, the hard copper wire and the hard copper alloy wire are changed to the soft copper wire and the soft copper alloy wire having lower bending resistance by heat treatment. Therefore, the heat history is preferred to be as less as possible when processing. Note that the hard copper wire is also defined in JIS-C3101 (1994) and the soft copper wire is also defined in JIS-C3102 (1984). In the definition, the soft copper wire is defined to have 15% or more elongation in the outer diameter of 0.10 to 0.26 mm, 20% or more elongation in the outer diameter of 0.29 to 0.70 mm, 25% or more elongation in the outer diameter of 0.80 to 1.8 mm, and 30% or more elongation in the outer diameter of 2.0 to 7.0 mm. In addition, the copper wire includes wires to which tin-plating is applied. The tin-plated hard copper wire is defined in JIS-C3151 (1994), and the tin-plated soft copper wire is defined in JIS-C3152 (1984). Furthermore, various shapes can be used as a cross sectional shape of the conductive wires 5*a*. Without being limited to wires having a circular cross section, although they are ordinary used, so-called a rectangular wire can be also used.

However, when the conductive wires 5*a* are wound around the core wire 3, the material of conductive wires 5*a* is preferred to be selected from the above described materials of the conductive wires 5*a* so that an amount of spring-back is suppressed and a recovery rate is 200% or less. For example, if the silver containing copper alloy in which fiber shaped copper solid solution and silver-copper eutectic alloy are included is used, although tensile strength and bending resistance are excellent, spring-back is easily caused when it is wound. Therefore, the silver containing copper alloy is not preferred because the conductive wires 5*a* is easily floated when the conductive wires 5*a* is wound around the core wire 3 and the conductive wires 5*a* is easily broken when excessive winding tension force is applied. In addition, winding habit is easily formed after the winding process. In particular, when the insulating film 5*b* is coated on the conductive wires 5*a*, the recovery rate of the insulating film 5*b* is also added. Therefore, it is important that conductive wires 5*a* having low recovery rate is selected so as to compensate the recovery force of the insulating film 5*b*.

Here, the measurement of the recovery rate defined in the present invention will be described in detail. At first, while a predetermined load is applied to the conductive wires, the conductive wires are wound more than three times around a cylinder-shaped mandrel having a diameter of 60 times larger than a diameter of the conductive wires so that the conductive wires are not overlapped with each other. After 10 minutes have passed, the load is removed, the conductive wires are removed from the mandrel, an inner diameter of the shape restored by elasticity is measured, and a rate of the spring-back of the conductive wires is calculated by the following formula (I) so that the calculated rate is evaluated as the recovery rate.

$$R=(d_2/d_1)\times 100 \quad \text{(I)}$$

EXPLANATION OF SYMBOLS

R: recovery rate (%)
d1: diameter of mandrel used for winding test (mm)
d2: inner diameter of shape restored by releasing load after conductive wires are wound around mandrel (mm)

Regarding the insulating film 5*b* that is covered on the conductive wires 5*a*, a polyurethane resin, a polyamide resin, a polyimide resin, a polyamide imide resin, a polyester imide resin, a nylon resin, a polyester-nylon resin, a polyethylene resin, a polyester resin, a vinyl chloride resin, a fluorine resin, and a silicone can be used, for example. However, the materials that contain the silicon should be selected from the above listed materials. The silicone is a collective term of artificial polymeric compounds having a main framework structure formed by a siloxane bond. The silicone takes a form of a silicone resin and a silicone rubber (silicone elastomer), for example. An amount of a methyl group and a phenyl group as a substituent can be arbitrarily adjusted. Other substituents such as an ether group, a fluoroalkyl group, an epoxy group, an amino group, and a carboxyl group can be arbitrarily added. In addition, a mixture of the silicone resin and other polymeric materials or a copolymer of a polysiloxane and other polymeric components can be used. As an example, a so-called alkyd silicone, which is obtained by mixing the polyester resin and the silicone resin, or a so-called acrylic silicone, which is a graft copolymer of an acrylic polymer and a dimethyl polysiloxane, can be used. An amount of the silicone resin contained in the insulating film 5*b* is preferably within a specific range in various specific viewpoints. Note that, when using the copolymer of the silicone resin and other polymeric components, a weight of only the silicone resin in the copolymer should be calculated as an amount of the silicone resin. If the amount of the silicone resin is insufficient, the insulating film 5*b* may be removed since the other components are pyrolyzed by the heat generated when the spark occurs. In addition, a bad influence may be given to an appearance. A content of the silicone resin is preferably 10% or more by a weight ratio because the requirements are satisfied in the viewpoint of the flame retardancy. Furthermore, the content of the silicone resin is preferably 20% or more, and can be 30% or more, 40% or more, 50% or more, 60% or more, 70% or more, 80% or more, and 90% or more. If the amount of the silicone resin is too much, wettability is reduced. This makes it difficult to be applied to the conductive wires 5*a*. Thus, an appearance may be affected. In addition, because of that, insulation performance of the insulating film 5*b* can be insufficient. From the above described viewpoints, the content of the silicone resin is preferably 90% or less, and can be 80% or less, 70% or less, 60% or less, 50% or less, 40% or less, 30% or less, and 20% or less. In addition, a primer can be preliminary applied to the conductive wires 5*a* so that adhesion between the conductive wires 5*a* and the insulating film 5*b* is improved.

The above described insulating film 5*b* containing the silicone resin has excellent heat resistance, incombustibility, and chemical stability. Even if the insulating film 5*b* is subjected to high heat when the spark is generated, a silicon oxide film is formed and therefore an insulation can be maintained. Furthermore, a siloxane gas is generated by high heat when the spark is generated. Since the silicon oxide film is precipitated from the siloxane gas at an end surface of the conductive wires and the end surface is insulated, the spark can be prevented after that.

Figure 13:
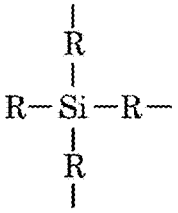
FIG. 13 is a drawing showing a structural unit of a silicone resin.
Figure 13:
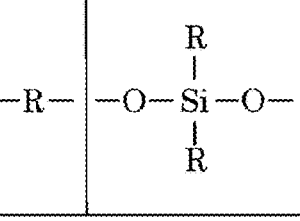
Figure 13:
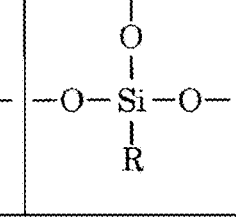
Figure 13:
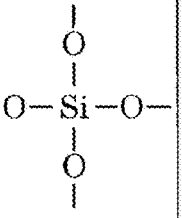
Figure 14:
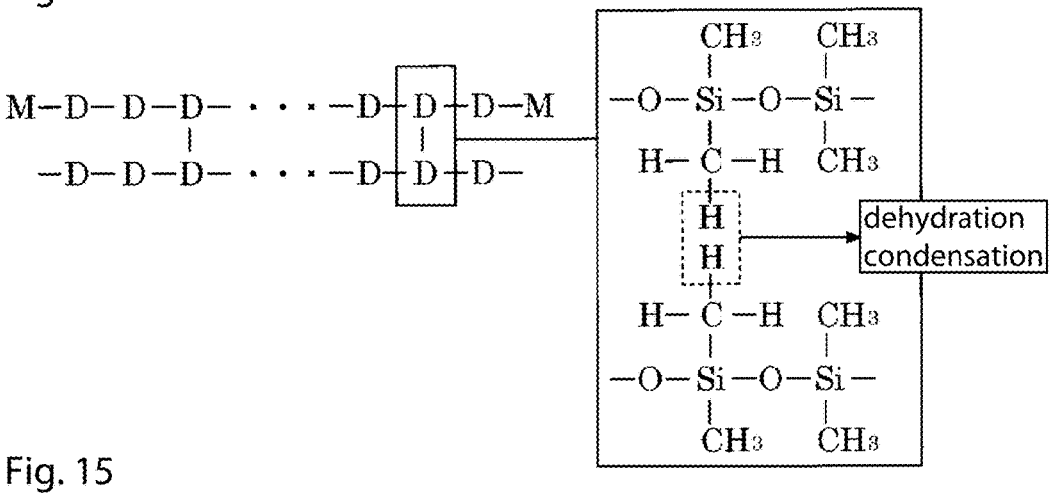
FIG. 14 is a drawing showing a molecular structure of a silicone rubber.
Figure 15:
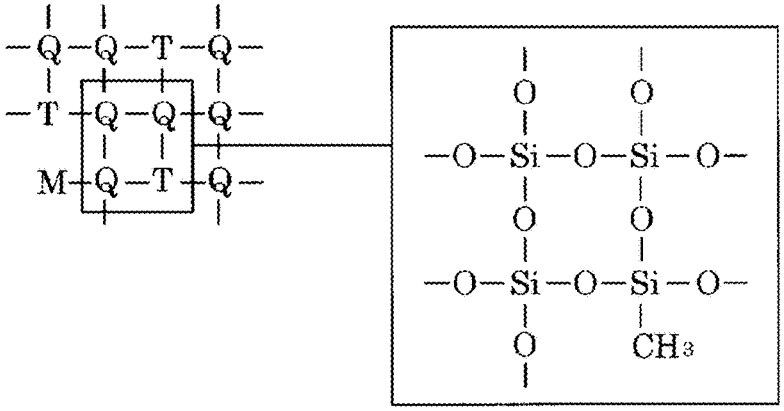
FIG. 15 is a drawing showing a molecular structure of the silicone resin.

Here, the silicone resin used in the present invention will be explained. FIG. 13 is a drawing showing a structural unit of the silicone resin. FIG. 14 is a drawing showing a molecular structure of the silicone rubber. FIG. 15 is a drawing showing a molecular structure of the silicone resin.

At first, the silicone resin is a polymer consisting of four basic units (M-unit, D-Unit, T-unit, Q-Unit). A substance called the silicone rubber consists of the M-unit and the D-unit, is a linear polymer, and is in a rubbery state by crosslinking. In other words, crosslinking is formed by peroxide or UV radiation, for example. Meanwhile, a substance called the silicone resin is a branched polymer containing the T-unit and the Q-unit, and has a three-dimensional network structure. For example, crosslinking is formed by hydrolysis or polycondensation of chlorosilane derivative.

Although FIG. 13 and FIG. 15 are drawn in a planar shape, a molecular structure of the silicone resin is a three-dimensional structure because a connection of —O—

Si—O— is spirally continued and the Q-unit and the T-unit are partly extended in a depth direction of the sheet.

Regarding the molecular structure, the above described difference exists between the silicone rubber and the silicone resin. On the other hand, from another point of view, the silicone rubber and the silicone resin can be distinguished by a so-called glass transition point.

In a rubber including the silicone rubber, the glass transition point is −124° C., as an example. On the other hand, in a resin including the silicone resin, the glass transition point is room temperature or higher. Therefore, the silicone resin used in the present invention has the glass transition point of 20° C. or higher. If the silicone resin having the glass transition point of 20° C. or higher is used, the present invention can be applied. Note that a surface temperature of the sheet-shaped heater is around 40° C. in some situations, and increased up to around 120° C. during rapid heating. In such cases, there is no problem even if the glass transition point is lower than these temperatures. This is because the silicone resin is not rapidly softened just after exceeding the glass transition point.

On the other hand, the glass transition point can be specified with reference to an average temperature of the sheet-shaped heater when used for the sheet-shaped heater. For example, if the average temperature of the sheet-shaped heater is 40° C., the glass transition point can be specified to 40° C. If the average temperature of the sheet-shaped heater is 60° C., the glass transition point can be specified to 60° C.

The silicone resin as describe above is coated on the conductive wires 5*a* to be served as the insulating film 5*b* by applying the silicone resin on the conductive wires 5*a* in a state that the silicone resin is dissolved or dispersed in a solvent, a solvating media such as water, or a dispersion media and then drying it, or by forming the silicon resin on an outer periphery of the conductive wires 5*a* using a forming means such as an extrusion molding, for example. The extrusion molding of the silicone resin can be performed at a relatively constant temperature. However, when applying the silicone resin dissolved or dispersed in the solvent, the water or other media, the silicon resin is exposed to a relatively high temperature environment so that drying is finished shortly. As explained above, the conductive wires 5*a* made of the copper wire and the copper alloy wire changes its characteristics between soft and hard by the heat history. Therefore, considering this point, the method of forming the insulating film 5*b* should be selected. In addition, when forming the insulating film 5*b*, a thickness of the insulating film 5*b* can be thinner when the silicon resin is applied compared to the extrusion molding. As a result, a diameter of the cord-shaped heater can be thinner.

A thickness of the insulating film 5*b* is preferably 3 to 30% of the diameter of the conductive wires 5*a*. If the thickness is less than 3%, voltage resistance is insufficient and therefore an individual coating of the conductive wires 5*a* may become meaningless. If the thickness exceeds 30%, it becomes difficult to remove the insulating film 5*b* when connection terminals are press-bonded, and the cord-shaped heater becomes unnecessarily thick.

When winding the conductive wires 5*a* around a core material 3 in a state of being paralleled together or twisted together, the paralleled state is more preferable than the twisted state. This is because the diameter of the cord-shaped heater becomes smaller and a surface becomes smooth. In addition to the paralleled state and the twisted state, the conductive wires 5*a* can be braided on the core material 3.

In the cord-shaped heater of the present invention, the insulation body layer 7 is preferably formed on an outer periphery of the conductive wires 5*a* on which the insulating film 5*b* is formed. If, by any chance, the conductive wires 5*a* is disconnected, power supply to other members are insulated by the insulation body layer 7. Furthermore, even when the spark occurs, generated heat of high temperature is insulated. It is known that a contact failure may be caused when electric components having a relay and a switch are exposed to the siloxane gas. If the insulation body layer 7 is formed, the siloxane gas is prevented from leaking by the insulation body layer 7, and the siloxane gas is precipitated as an oxidized silicon inside the insulation body layer 7. Therefore, the contact failure is not caused even when the electric components are arranged closely. Note that, in the present invention, the silicone resin is contained only in an extremely thin insulating film 5*b*, and a density of the siloxane gas discharged is extremely low. Therefore, actually, there is little possibility that the siloxane gas due to the silicone resin contained in the insulating film 5*b* causes any problems on the electric components.

When forming the insulation body layer 7, the method of forming is not particularly limited. For example, the extrusion molding can be used, and the insulation body layer 7 can be preliminary formed in a tubular shape to be covered on the conductive wires 5*a*. If the insulation body layer 7 is formed by the extrusion molding, a position of the conductive wires 5*a* is fixed. Since friction and bending caused by displacement of the position of the conductive wires 5*a* can be prevented, bending resistance is improved. Therefore, the extrusion molding is preferred. Materials forming the insulation body layer 7 can be arbitrarily specified according to usage pattern and usage environment of the cord-shaped heater. For example, various resins such as a polyolefin-based resin, a polyester-based resin, a polyurethane-based resin, aromatic polyamide-based resin, an aliphatic polyamide-based resin, a vinyl chloride resin, a modified-Noryl resin (polyphenylene oxide resin), a nylon resin, a polystyrene resin, a fluororesin, a synthetic rubber, a fluororubber, an ethylene-based thermoplastic elastomer, an urethane-based thermoplastic elastomer, a styrene-based thermoplastic elastomer, a polyester-based thermoplastic elastomer can be used. In particular, a polymer composition having flame retardancy is preferably used. Here, the polymer composition having flame retardancy means the polymer composition having an oxygen index of 21 or more in the flame retardant test defined in JIS-K7201 (1999). The polymer composition having the oxygen index of 26 or more is especially preferred. In order to obtain the above described flame retardancy, a flame retardant material or other material can be arbitrarily added to the material forming the above described insulation body layer 7. As for the flame retardant material, metal hydrates such as a magnesium hydroxide and an aluminum hydroxide, an antimony oxide, a melamine compound, a phosphorus compound, chlorine-based flame retardant, and a bromine-based flame retardant can be used, for example. A surface treatment can be arbitrarily applied to the above described flame retardant materials by a conventionally known method.

In addition, if the insulation body layer 7 is formed of the heat-fusing material, the cord-shaped heater 10 can be heat-fused with the substrate 11 by heating and pressing. In such a case, an olefin-based resin is preferred in the above listed materials forming the insulation body layer 7 because the olefin-based resin is excellent in adhesion to the substrate. Regarding the olefin-based resin, a high density polyethylene, a low density polyethylene, an ultra-low density polyethylene, a linear low density polyethylene, a polypropylene, a polybutene, an ethylene-α-olefin copolymer, and an ethylene-unsaturated ester copolymer can be used, for example. In the above listed materials, the ethylene-unsaturated ester copolymer is especially preferred. The ethylene-unsaturated ester copolymer has a molecular structure containing oxygen in the molecular. Therefore, a heat of combustion is lower compared to the resins such as the polyethylene, which has a molecular structure consisting only of carbon and hydrogen. As a result, the combustion is suppressed. In addition, the ethylene-unsaturated ester copolymer originally has high adhesiveness. Therefore, the ethylene-unsaturated ester copolymer is excellent in adhesion to the substrate, and deterioration of the adhesiveness is low when mixed with inorganic powders or the like. Thus, the ethylene-unsaturated ester copolymer is suitable for mixing with various flame retardant materials. Regarding the ethylene-unsaturated ester copolymer, an ethylene-vinyl acetate copolymer, an ethylene-(meth) acrylic acid methyl copolymer, an ethylene-(meth) acrylic acid ethyl copolymer, and an ethylene-(meth) acrylic acid butyl copolymer can be used, for example. The above listed materials can be used independently or two or more kinds can be mixed. Here, "(meth) acrylic acid" means both acrylic acid and methacrylic acid. The material can be arbitrarily selected from the above listed materials. However, the material melted at a temperature equal to or lower than a kick-off temperature or a melting temperature of the above described material forming the insulating film 5*b* is preferred. In addition, regarding the material excellent in adhesion to the substrate 11, a polyester-based thermoplastic elastomer is exemplified. Regarding the polyester-based thermoplastic elastomer, there are both a polyester-polyester type and a polyester-polyether type. However, the polyester-polyether type is preferred because the adhesiveness is higher. Note that, when the cord-shaped heater 10 and the substrate 11 are heat-fused together, adhesion strength between the cord-shaped heater 10 and the substrate 11 is very important. If the adhesion strength is not enough, the substrate 11 and the cord-shaped heater 10 are peeled off during repeated use. Because of this, unexpected bending is applied to the cord-shaped heater 10. Thus, possibility of the disconnection fault of the conductive wires 5*a* is increased. If the conductive wires 5*a* are disconnected, a role of the heater is lost, and also a spark may be generated by chattering.

The insulation body layer 7 is not limited to a single layer. Multiple layers can be formed. For example, after a layer of the fluorine resin is formed on an outer periphery of the conductive wires 5*a*, a layer of the polyethylene resin can be formed around an outer periphery of that so as to form the insulation body layer 7 by these two layers. Of course, more than three layers can be used. In addition, the insulation body layer 7 is not necessarily formed continuously in a length direction. For example, the insulation body layer 7 can be formed linearly or spirally along the length direction of the cord-shaped heater 10, formed in a dot pattern, or formed intermittently. In these cases, it is preferred that the heat-fusing material is not continued in the length direction of the cord-shaped heater, because combustion part is not expanded even when a part of the heat-fusing material is ignited. In addition, if a volume of the heat-fusing material is small enough, combustibles disappear soon even when combustible materials are used for the heat-fusing material. Thus, fire is extinguished and drippings (burning drippings) are stopped. Therefore, it is preferred that the volume of the heat-fusing material is suppressed to the minimum capable of keeping the adhesiveness to the substrate 11.

When a bending-resistance test, which is performed by repeatedly bending in an angle of 90° with a radius of curvature of 6 times of the self-diameter, is performed for the cord-shaped heater 10 obtained above, the number of bending until the break of at least one of the conductive wires is preferably 20,000 times or more.

Regarding the substrate 11, in addition to the nonwoven fabric shown in the above embodiment, various materials such as a woven fabric, a paper, an aluminum foil, a mica plate, a resin sheet, a foamed resin sheet, a rubber sheet, a foamed rubber sheet, or a stretched porous material can be used, for example. However, the materials having flame retardancy satisfying the requirements of the combustion test of the automobile interior material of FMVSS No. 302 is preferred. Here, FMVSS means Federal Motor Vehicle Safety Standard. The combustion test of the automobile interior material is defined in No. 302 of FMVSS. In the above listed materials, the nonwoven fabric is especially preferred to be used for the car seat heater because the nonwoven fabric has a good touch feeling and is soft. In the case of using the nonwoven fabric in the above described embodiment, the fiber having the core-sheath structure is used as the heat-fusing fiber forming the nonwoven fabric and the low-melting polyester is used as the sheath component in the core-sheath structure. Other than this, a low-melting polypropylene or a polyethylene can be used as the sheath component in the core-sheath structure of the fiber, for example. By using the above described heat-fusing fiber, a sheath portion of the heat-fusing fiber and the heat-fusing material of the insulation body layer 7 are fused together and integrated in a state of surrounding a core portion of the heat-fusing fiber. Thus, the adhesion between the cord-shaped heater 10 and the nonwoven fabric becomes very strong. Regarding the flame retardant fiber, in addition to the above described flame retardant polyester, various flame retardant fibers can be used. Here, the flame retardant fiber means the fiber satisfying the requirements JIS-L1091 (1999). By using the above described flame retardant fiber, an excellent flame retardancy is applied to the substrate.

A mixture ratio of the heat-fusing fiber is preferably 5% or more and 20% or less. If the mixture ratio of the heat-fusing fiber is less than 5%, the adhesiveness is insufficient. If the mixture ratio of the heat-fusing fiber exceeds 20%, the nonwoven fiber becomes hard. That causes a feeling of strangeness to a seated person, and reduces the adhesiveness to the cord-shaped heater instead. Furthermore, the substrate is shrunk by the heat of the heat-fusion, and dimensions intended in the product design may not be obtained. The mixture ratio of the flame retardant fiber is 70% or more, and is preferably 70% or more and 95% or less. If the mixture ratio of the flame retardant fiber is less than 70%, the flame retardancy is insufficient. If the mixture ratio of the flame retardant fiber exceeds 95%, the mixture ratio of the heat-fusing fiber is relatively insufficient and the adhesiveness is insufficient. Note that a sum of the mixture ratio of the heat-fusing fiber and the mixture ratio of the flame retardant fiber is not necessarily 100%. Other fibers can be arbitrarily mixed. Even if the heat-fusing fiber is not mixed, sufficient adhesiveness can be obtained by, for example, using similar types of materials both for the material of the heat-fused portion and the material of the fiber forming the substrate. Therefore, it can be reasonably assumed that the heat-fusing fiber is not mixed.

A size, a thickness and other conditions of the nonwoven fabric are arbitrarily changed according to the usage. However, the thickness (a value measured in a dried condition) is preferably approximately 0.6 mm to 1.4 mm. By using the nonwoven fabric having the above described thickness, when the cord-shaped heater and the nonwoven fabric are adhered and fixed with each other by heating and pressing, the nonwoven fabric adheres with 30% or more, preferably 50% or more, of the outer periphery of the cord-shaped heater. Thus, the adhesion can be strong.

In the above listed substrates, the substrate having gaps are preferred. In particular, it is preferred that more gaps are provided in a surface (hereafter, referred to as an arrangement surface) on which the cord-shaped heater is arranged than another surface (hereafter, referred to as a non-arrangement surface) on which the cord-shaped heater is not arranged. For example, in cloth bodies such as a woven fabric and a nonwoven fabric, a state of having many gaps means a state of having a small unit weight, i.e. fiber weight per unit volume. In porous bodies such as a foamed resin sheet and a foamed rubber sheet, a state of having many gaps means a state of having a large porosity. As specific embodiments of the substrate, a woven fabric or a nonwoven fabric formed by carrying out calendar processing on one side or both sides so that different strength are applied on each side by adjusting a temperature and a pressure, a nonwoven fabric formed by carrying out needle punching only from one side, a cloth body on which piles or raising are formed on one side, a foamed resin sheet or a foamed rubber sheet formed so that a porosity is gradually changed in a thickness direction, or materials formed by sticking materials having different porosities together can be used, for example. In particular, the porosities of the substrate are preferably continued. This is because the melted heat fusion layer penetrates in the continued porosities. Thus, anchor effect is increased and adhesive strength is improved. Regarding the state of continuing the porosities, cloth bodies, i.e. fiber aggregate, such as a woven fabric and a nonwoven fabric, and a foamed resin sheet or a foamed rubber sheet having continuous pores can be considered. Note that materials not having porosities can be used for the non-arrangement surface.

When the cord-shaped heater 10 is arranged on the substrate 11, in addition to the embodiment of adhering and fixing by the fusion of heating and pressing, the cord-shaped heater 10 can be fixed on the substrate 11 by using other embodiments. For example, various embodiments can be considered, such as an embodiment of adhering and fixing by melting the insulation body layer 7 made of heat-fusing material using hot air, an embodiment of adhering and fixing by melting the insulation body layer 7 made of the heat-fusing material using heat generation generated by energizing the conductive wires 5*a*, and an embodiment of sandwiching and fixing by a pair of substrates 11 while heating.

Figure 10:
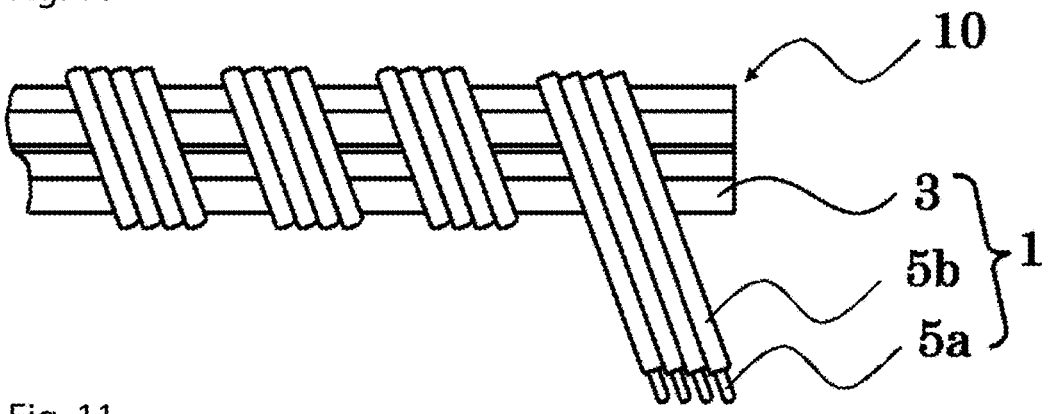
FIG. 10 is a drawing showing another embodiment of the present invention, and is a partially cutaway side view showing a configuration of the cord-shaped heater.
Figure 11:
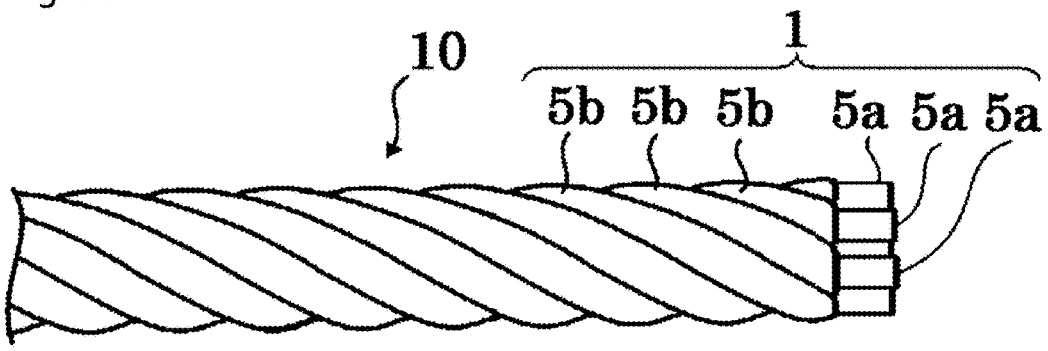
FIG. 11 is a drawing showing another embodiment of the present invention, and is a partially cutaway side view showing a configuration of the cord-shaped heater.

The embodiment not using the heat-fusing material can be also considered. For example, the cord-shaped heater 10 can be arranged on the substrate 11 by sewing, or the cord-shaped heater 10 can be sandwiched and fixed by a pair of substrates 11. In these cases, the embodiments not forming the insulation body layer 7 can be considered as shown in FIG. 10 and FIG. 11.

Regarding the adhesive layer to fix the sheet-shaped heater 31 on the sheet, it is preferred that the adhesive layer is formed by forming an adhesive layer only made of an adhesive material on a release sheet or the like and then transferring the adhesive layer from the release sheet to a surface of the substrate 11 in the viewpoint of stretchability of the substrate 11 and keeping of good touch feeling. In addition, the adhesive layer preferably has flame retardancy. The adhesive layer preferably has flame retardancy satisfying the requirements of the combustion test of the automobile interior material of FMVSS No. 302 when the adhesive layer is independently used. For example, an acrylic polymer-based adhesive can be considered. The adhesive layer can be formed on the arrangement surface or the non-arrangement surface of the substrate.

Examples

By using the same method as the above described embodiments, the bending-resistance test was performed on the cord-shaped heater 10 (shown in FIG. 1) obtained by winding the conductive wires 5*a* having the insulating film 5*b* around the core material 3 as an example 1. In addition, the conductive wires 5*a* were extracted from the cord-shaped heater, and a tensile strength, an elongation and a breakdown voltage are measured and a horizontal flame test was performed for the conductive wires 5*a*. A test result and a specification of the example 1 are shown in Table 1.

Figure 12:
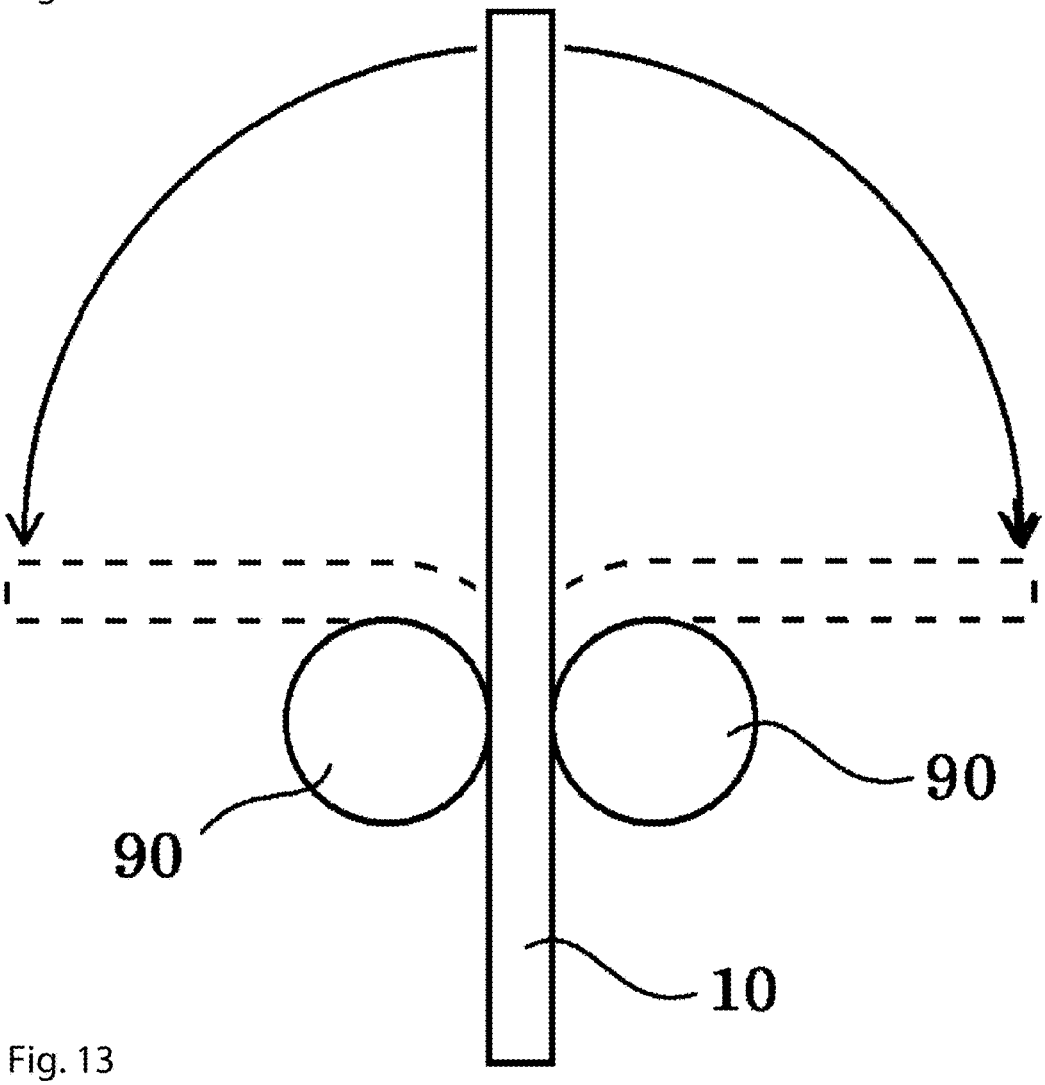
FIG. 12 is a reference drawing for explaining a method of a bending test.

The bending-resistance test was performed by repeatedly bending in an angle of 90° with a radius of curvature of 6 times of the self-diameter, and the number of bending until the break of at least one of the conductive wires 5*a* was counted. In this test, a resistance value of each of the conductive wires 5*a* was measured in advance, the cord-shaped heater was sandwiched by a pair of mandrels 90 having a radius of 5 mm as shown in FIG. 12, the cord-shaped heater was bent to both sides at an angle of 90° in a direction perpendicular to the mandrels 90 as one bending, and the number of bending until the disconnection was counted. On this occasion, the disconnection was judged to occur when the resistance value of one of the conductive wires 5*a* became positive infinity. The mechanical strength and the elongation were measured conforming to JIS-C3002 (1992) by fixing one end of the conductive wires 5*a*, pulling the other end by a tensile testing machine and measuring the strength and the elongation when the conductive wires 5*a* was cut. Regarding a withstand voltage test, a breakdown voltage of the insulating film 5*b* was tested. In order to support the business use, a voltage of 200V was applied to the conductive wires 5*a*, and the presence/absence of the breakdown was confirmed. The horizontal flame test was measured conforming to UL1581 horizontal flame test (2008, 4th-edition). The width influenced by the flame was also measured.

As a comparative example 1, the cord-shaped heater of the above described example 1 was also tested by replacing the insulating film 5*b* with the one formed by baking a heat-resistant polyurethane resin. A test result is shown in Table 1 with a specification of the comparative example 1.

TABLE 1

| | example 1 | comparative example 1 |
|---|---|---|
| core material | aromatic polyamide fiber bundle | aromatic polyamide fiber bundle |
| conductive wire | soft copper alloy wire diameter: 0.08 mm including 0.3% of tin 5 wires are paralleled together | soft copper alloy wire diameter: 0.08 mm including 0.3% of tin 5 wires are paralleled together |
| insulating film | alkyd silicon resin (alkyd:silicon = 50:50) thickness: 5 μm | heat-resistant polyurethane resin thickness: 7 μm |
| bending resistance | 2412 times | 1616 times |
| tensile strength | 317 MPa | 228 MPa |
| elongation | 11% | 22% |
| breakdown voltage | 0.5 kV | 1.4 kV |
| horizontal flame test | satisfy (25 mm) | satisfy (60 mm) |

As shown in Table 1, it was confirmed that the cord-shaped heater 10 of the example 1 had a necessary and sufficient property in the bending resistance, the tensile strength, the elongation, and the breakdown voltage. In the horizontal flame test, the width influenced by the flame was 25 mm. This was almost same as the width of the flame. Therefore, the cord-shaped heater 10 was confirmed to be unburnable. Even at a part to which the flame is directly applied, the insulating film 5*b* was remained and the conductive wires 5*a* were not exposed. On the other hand, even though the cord-shaped heater of the comparative example 1 satisfies the requirements of the flame test itself, the flame is partly propagated to the insulating film. In addition, the insulating film was removed with the width of 60 mm and the conductive wires 5*a* were exposed.

Regarding the conductive wires 5*a* made of the tin-containing hard copper alloy wire having a strand diameter of 0.08 mm, the insulating films 5*b* were alternatively formed by changing the quantity (weight ratio) of the silicone contained in the alkyd silicone varnish as shown in Table 2 as reference examples 1 to 9. The flame test, measurement of line-to-line insulation resistance, measurement of line-to-line BDV (breakdown voltage), and appearance check were performed for these conductive wires 5*a*. Test results are also shown in Table 2.

In the flame test, 80 conductive wires 5*a* were bundled and used. The flame test was measured conforming to UL1581 horizontal flame test (2008, 4th-edition). The width influenced by the flame was also measured. The line-to-line insulation resistance was measured conforming to JIS-C3216-5 (2011). The line-to-line BDV (breakdown voltage) was measured conforming to JIS-C3216-5 (2011). Regarding the appearance check, roughness and unevenness of the surface were confirmed by acquiring a shape using a SEM and touching by hand.

TABLE 2

| | reference example 1 | reference example 2 | reference example 3 | reference example 4 | reference example 5 |
|---|---|---|---|---|---|
| quantity of silicone | 10% | 20% | 30% | 40% | 50% |
| flame test | Satisfy 50 mm | Satisfy 50 mm | Satisfy 50 mm | Satisfy 45 mm | Satisfy 40 mm |
| breakdown voltage ($10^5$ MΩ) | 6.0 | 1.8 | 1.0 | 10.5 | 20.0 |
| BVD (V) | 975 | 550 | 475 | 600 | 1100 |
| appearance | x | x | x | ○ | ○ |

| | reference example 6 | reference example 7 | reference example 8 | reference example 9 |
|---|---|---|---|---|
| quantity of silicone | 60% | 70% | 80% | 90% |
| flame test | 35 mm Satisfy | 30 mm Satisfy | 23 mm Satisfy | 20 mm Satisfy |
| breakdown voltage ($10^5$ MΩ) | 3.5 | 15.0 | 10.6 | 11.5 |
| BVD (V) | 475 | 900 | 475 | 1075 |
| appearance | ○ | ○ | ○ | x |

As shown in Table 2, the conductive wires 5*a* of the reference examples 1 to 9 satisfied the requirements of the flame test even when the wires were independently used. Therefore, the reference examples 1 to 9 were confirmed to have high flame retardancy. In particular, in the reference examples 4 to 9, which contained 40% or more of the silicone resin, the width influenced by the flame was less than twice the width (25 mm) of the flame, the insulating film 5*b* was remained, and the conductive wires 5*a* were not exposed. Therefore, the reference examples 4 to 9 were confirmed to have excellent flame retardancy. In the reference examples 1 to 3, the insulating film 5*b* was removed, although only a little. Since the quantity of the silicone resin was less than 40% in the reference examples 1 to 3, unevenness was formed on the surface and the appearance was slightly inferior. On the other hand, since the quantity of the silicone resin was more than 90% in the reference example 9, roughness was formed and the appearance was also slightly inferior. However, the requirements of the flame test were satisfied in the whole range of 10% to 90% in the quantity of the silicone resin.

Conventionally, an insulating film 5*b* was formed of a resin not containing the silicone resin. A preferable result could not be obtained in the conventional product in the viewpoint of the flame retardancy. On the other hand, if the silicone resin was used, although good property could be expected in the viewpoint of flame retardancy, sufficient performance could not be obtained only by the silicone resin in the performance of cut-through strength and bending performance, which will be explained below.

Figure 16:
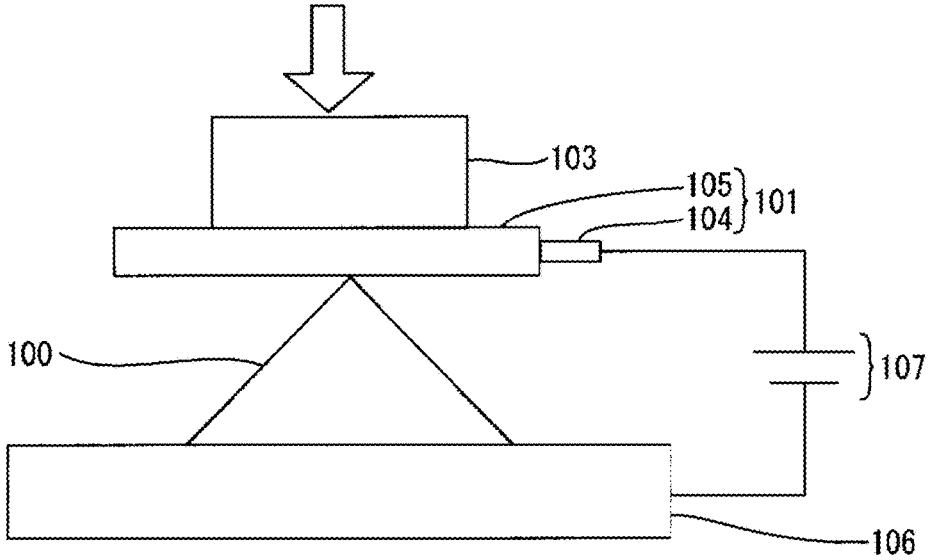
FIG. 16 is a drawing schematically showing a test method of a cut-through strength.

FIG. 16 is a drawing schematically showing a test method of the cut-through strength.

As shown in the figure, a sample 101 is placed on a V-shaped edge 100 having a cross-sectional angle of 90°, a load 103 is gradually applied to the sample 101, and the maximum load before conduction begins is measured. The sample 101 is formed by coating a film 105 of non-conductive material around a core wire 104 of conductive material. The V-shaped edge 100 is placed on a base 106 of conductive material, and a continuity checker 107, which is made of an electric power source and a driven element, is interposed between the base 106 and the core wire 104. Initially, the film 105 is kept against the V-shaped edge 100 and insulation is maintained. The load 103 is gradually increased and the V-shaped edge 100 cuts the film 105 at a certain point and the V-shaped edge 100 is in contact with a core wire 104. Then, both ends of the continuity checker 107 become a conducting state, and a lamp is flashed or a buzzer is beeped. In other words, in the evaluation of the cut-through strength, the load is measured when the state is changed from a non-conductive state to the conductive state in the film 105. For more detailed explanation, refer to the item of 5.13 Cutting in CSA (Canadian Standards Association) C22.2 No. 0.3-09.

In Table 3, the cut-through strength of the silicone rubber and resins made of various single components is compared.

TABLE 3

| sample | cut-through strength (kg) |
|---|---|
| silicone rubber | 0.31 |
| acrylic | 1.2 |
| epoxy | 1.8 |
| alkyd | 4 |
| silicone resin | 9.8 |

The silicone rubber is 0.31 kg. Thus, the silicone rubber is too soft and cannot withstand actual use at all. The silicone resin is 9.8 kg. This indicates that the silicone resin has very high durability. The acrylic, which is a resin made of single component, is 1.2 kg. The durability is slightly low. On the other hand, the epoxy is 1.8 kg. The durability is satisfactory.

Next, in Table 4, the cut-through strength of mixtures of the silicone resin and other resins is compared.

TABLE 4

| sample | cut-through strength (kg) |
|---|---|
| silicone resin + alkyd | 2.1 |
| silicone resin + polyester | 5.5 |
| silicone resin + acrylic | 14.4 |
| silicone resin + epoxy | 18.8 |

In the comparison of the resins made of single component, the alkyd had higher (harder) evaluation value compared to the acrylic and the epoxy. However, when mixed with the silicone resin, the evaluation value of the mixture of the silicone resin and the alkyd was 2.1 kg and the evaluation value of the mixture of the polyester and the silicone resin was 5.5 kg. These values were lower compared to the values of the mixture of the silicone resin and the acrylic or the mixture of the silicone resin and the epoxy. In addition, the alkyd and the polyester lowered the value of the silicone resin compared to the single use of the silicone resin. Therefore, it can be said that the alkyd and the polyester imparts softness.

In addition to the evaluation of the cut-through strength, the bending performance was evaluated next.

In the first evaluation of the bending performance, a film (thickness: about 0.2 mm) was formed on an aluminum foil, the aluminum foil was wound around various pin gauges, and an appearance of the film was evaluated. In the examples shown in Table. 5, pin gauges having thicknesses of R=30 mm, R=15 mm, R=10 mm, R=5 mm and R=2 mm were prepared, the appearances of the film of the single use of the silicone resin and the mixture of the silicone resin were evaluated, and the results are shown. In this test, the polyester was evaluated as a generic concept of the alkyd, and the alkyd is considered to be equivalent to the polyester.

TABLE 5

| sample | R = 30 mm | R = 15 mm | R = 10 mm | R = 5 mm | R = 2 mm |
|---|---|---|---|---|---|
| silicone resin | x | x | x | x | x |
| silicone resin + polyester | ○ | ○ | ○ | ○ | ○ |
| silicone resin + acrylic | ○ | ○ | ○ | x | x |
| silicone resin + epoxy | x | x | x | x | x |

In the table, ○ indicates no change and x indicates occurrence of cracks.

In the present invention, five conductive wires 5*a* are spirally wound at a pitch of about 1.0 mm around an outer periphery of the core wire 3 in a state of being paralleled together. Since the circumference of the conductive wires 5*a* is covered with the insulating film 5*b* having a thickness of about 5 μm, the performance withstanding against the bending is required for the insulating film 5*b*. In other words, if the cracks occur in the material, the material tends to be too hard for the insulating film 5*b*. However, the material is effective for the insulating film 5*b* depending on the conditions such as a condition whether or not the conductive wires 5*a* are spirally wound.

Referring to the table, the cracks easily occur in the evaluation of the bending performance of the single use of the silicone resin and the mixture of the silicone resin and the epoxy. Therefore, these materials tend to be too hard for the insulating film 5*b* under this condition. In other words, it is undeniable that these materials are inferior to the resins not causing cracks. Therefore, these materials are not suitable for the insulating film when the conductive wires are wound around the core material in a state of forming the insulating film or when used in an environment subject to external forces such as bending. However, the situation can be improved by changing the conditions such as a condition whether or not to be wound.

Next, in the mixture of the silicone resin and the polyester (equivalent to the alkyd), the cracks did not occur in all pin gauges. However, in the mixture of the silicone resin and the acrylic, it was confirmed that the cracks occurred when using the pin gauges having small diameter. In other words, it is sure that the acrylic is inferior to the polyester and the alkyd in the bending performance when the diameter becomes small.

In the second evaluation of the bending performance, an insulating film having a thickness of 8 μm is formed on the core wire having a diameter of 0.08 mm, and the existence of cracks is evaluated by using pin gauges of R=1.5 mm, R=1.0 mm and R=0.5 mm.

Figure 17:
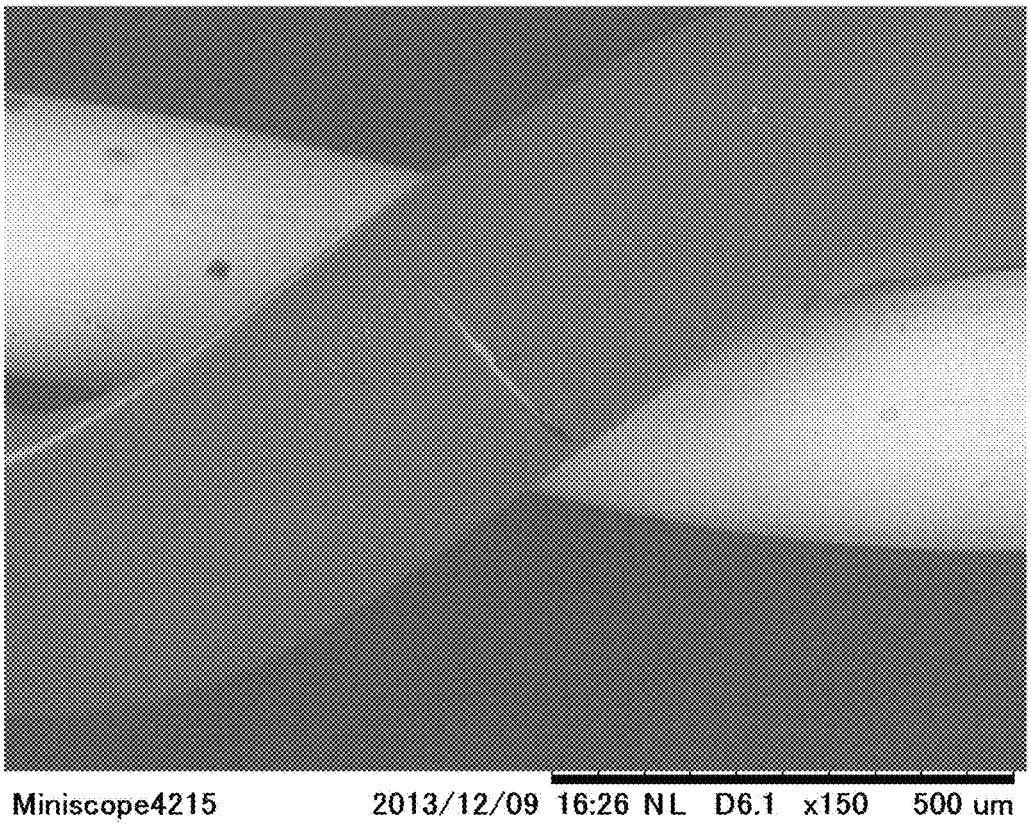
FIG. 17 is a drawing showing an electron microscope photograph of the silicone resin.
Figure 18:
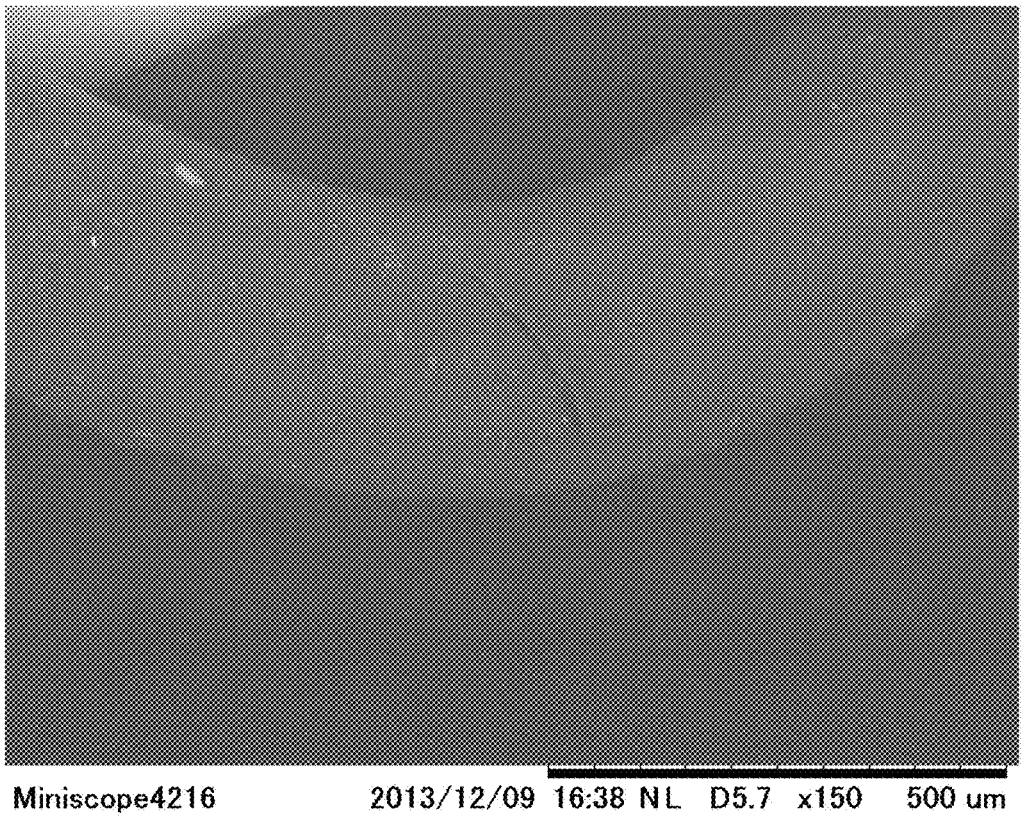
FIG. 18 is a drawing showing an electron microscope photograph of a mixture of the silicone resin and an epoxy.
Figure 19:
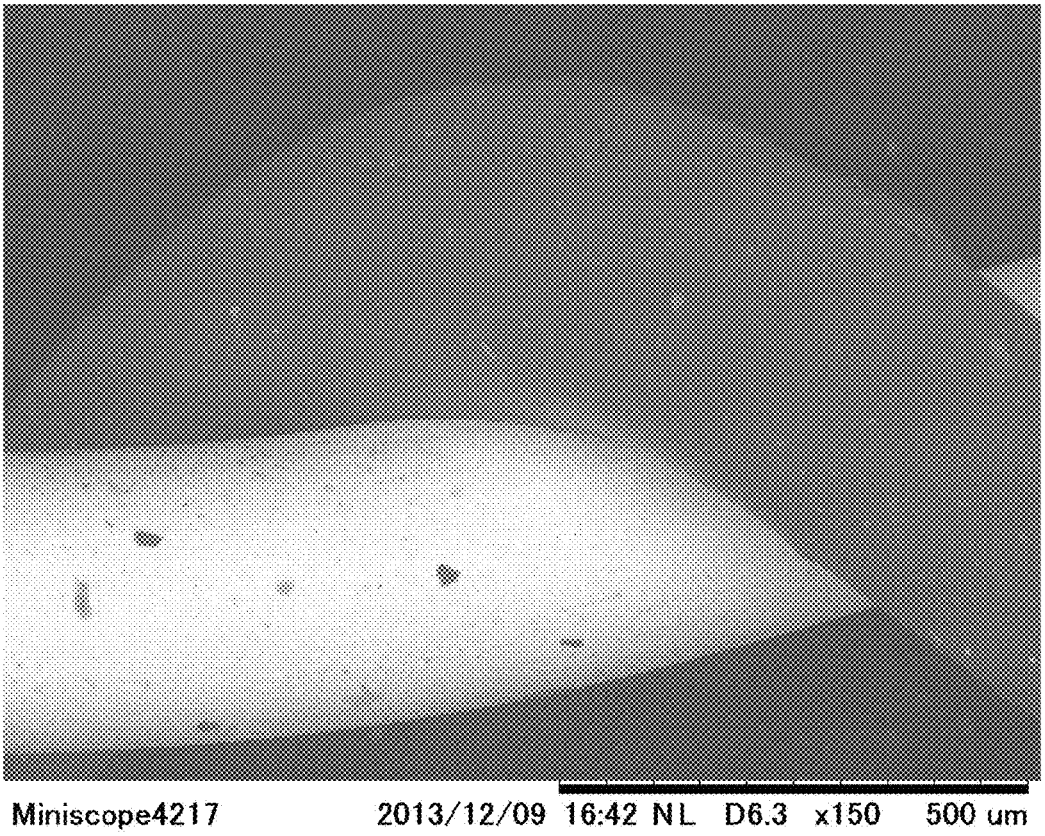
FIG. 19 is a drawing showing an electron microscope photograph of a mixture of the silicone resin and an alkyd.

FIG. 17, FIG. 18 and FIG. 19 are drawings showing electron microscope photographs confirmed in the second evaluation of the bending performance. FIG. 17 is the photograph of the silicone resin, and the cracks can be confirmed visually. FIG. 18 is the photograph of the mixture of the silicone resin and the epoxy, and the cracks can be confirmed visually. However, FIG. 19 is the photograph of the mixture of the silicone resin and the alkyd, and the cracks cannot be confirmed visually.

TABLE 6

| sample | R = 1.5 mm | R = 1.0 mm | R = 0.5 mm |
|---|---|---|---|
| silicone resin | x | x | x |
| silicone resin + epoxy | x | x | x |
| silicone resin + acrylic | ○ | ○ | ○ |
| silicone resin + alkyd | ○ | ○ | ○ |

As shown in the table, the cracks easily occur in the single use of the silicone resin and the mixture of the silicone resin and the epoxy. Therefore, it becomes clear again that these materials are too hard and not suitable for the insulating film 5*b*.

In the mixture of the silicone resin and the alkyd or the mixture of the silicone resin and the acrylic, the cracks did not occur in all pin gauges. However, as apparently shown in the first evaluation of the bending performance, it is easily presumed that the acrylic is inferior to the polyester and the alkyd in the bending performance when the diameter becomes small.

From the above evaluations, it is presumed that any resins not containing the silicone resin do not satisfy the flame retardancy. In this point, if the silicone resin is contained, good result can be obtained in the viewpoint of the flame retardancy. However, although the silicone resin is contained, the silicone rubber is too soft. Therefore, the silicone rubber cannot be used actually in the viewpoint of the durability. However, the reason that the silicone resin could not be used was only the viewpoint of the flame retardancy. In other words, the single use of the silicone resin was too hard and inferior in the bending performance Therefore, it was difficult to apply the single use of the silicone resin to the sheet-shaped heater, which is interposed between the sheet skin and the cushion.

If the weight ratio of the silicone resin is 40% or more, it could be confirmed that the width influenced by the flame was small, the film was not removed, and the flame retardancy was especially good. In the samples of containing 10 to 30% or 90% of the silicone resin, unevenness and roughness were formed and the appearance was slightly inferior.

It can be said that, when mixed with the silicone resin, the most suitable material to modify the silicone resin for imparting softness was the polyester or the alkyd. This is because these materials had a necessary minimum evaluation of the cut-through strength and good result was obtained in the evaluation of the bending performance.

As explained above, the most suitable material is the mixture of the silicone resin and the alkyd. However, it is not true that only the alkyd resin can be used. Considering a substitutive material of the alkyd resin, the material that modifies the silicone resin by entering into molecular structure of the silicone resin is preferred. From the above point of view, it can be assumed that the alkyd, the polyester, the urethane, the acrylic and the epoxy are preferred, for example. It can be also assumed that the materials capable of modifying the silicone resin can be used regardless of whether they actually modify the silicone resin or not.

In the present embodiment, five conductive wires 5*a* having a strand diameter of 0.08 mm are spirally wound at a pitch of about 1.0 mm around an outer periphery of the core wire 3 having an outer diameter of 0.2 mm in a state of being paralleled together. The insulating film 5*b* having a thickness of about 5 μm is formed on the conductive wires 5*a*. After the conductive wires 5*a* is wound around the core wire 3, the insulation body layer 7 is extrusion-covered with a thickness of 0.2 mm so that a finished outer diameter becomes 0.8 mm.

Of course, this is merely an example. It goes without saying that the actual dimensions are not limited to the above described values. If the finished outer diameter is within the range of 0.4 mm to 1.6 mm as shown below, the present invention can be sufficiently applied. If the outer diameter of the conductive wires 5*a* is within the range of 0.04 mm to 0.16 mm, the present invention can be sufficiently applied. If the film thickness of the insulating film 5*b* is within the range of 1 μm to 100 μm, the present invention can be sufficiently applied. If the core wire 3 is within the range of 0.1 mm to 0.4 mm, the present invention can be sufficiently applied.

As explained above in detail, the present invention provides the cord-shaped heater having high flame retardancy and capable of preventing generation of spark if, by any chance, a disconnection fault occurs. The cord-shaped heater can be used as the sheet-shaped heater, for example by being arranged on the substrate such as a nonwoven fabric and an aluminum foil in a predetermined shape such as a meandering shape. The sheet-shaped heater can be suitably used for an electric blanket, an electric carpet, a car seat heater, a steering heater, a heated toilet seat, an anti-fog mirror heater, and a heating cooker, for example. In addition, as the single use of the cord-shaped heater, the cord-shaped heater can be wound and adhered around a pipe, a tank or the like, or can be installed inside the pipe, for example. Regarding the practical use, the cord-shaped heater can be suitably used as an antifreezing heater for a piping and a pipe drain of a freezer, a heat retaining heater for an air conditioner and a dehumidifier, a defrosting heater for a refrigerator and a freezer, a drying heater and a floor heating heater, for example. The cord-shaped heater of the present invention can be directly adhered to or directly wound around the heating objects in the above listed examples of the usage of the sheet-shaped heater: the electric blanket, the electric carpet, the car seat heater, the steering heater, the heated toilet seat, the anti-fog mirror heater, the heating cooker, and the floor heating heater.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A cord-shaped heater having a plurality of conductive wires that are covered with an insulating film, wherein the insulating film includes a silicone resin, a quantity of the silicone resin included in the insulating film is 40 to 80% by a weight ratio, and the insulation film further includes one of a polyester, an acrylic and an alkyd in addition to the silicone resin.

2. The cord-shaped heater according to claim 1, wherein the conductive wires are wound around a core material in a state of being paralleled together.

3. The cord-shaped heater according to claim 1, wherein a film thickness of the insulating film is within a range of 1 μm to 100 μm.

4. The cord-shaped heater according to of claim 1, wherein an insulation body layer is formed on an outer periphery of the conductive wires.

5. The cord-shaped heater according to claim 4, wherein a part or all of the insulation body layer is formed of a heat-fusing material.

6. A sheet-shaped heater, comprising:

the cord-shaped heater according to claim 1; and a substrate on which the cord-shaped heater is arranged.

* * * * *